United States Patent [19]

Gothsche

[11] 4,117,927

[45] Oct. 3, 1978

[54] GAS TURBINE CONTAINER

[75] Inventor: Friedrich Gothsche, Munich, Fed. Rep. of Germany

[73] Assignee: Motoren- und Turbinen-Union Munchen GmbH, Fed. Rep. of Germany

[21] Appl. No.: 747,929

[22] Filed: Dec. 6, 1976

[30] Foreign Application Priority Data

Dec. 5, 1975 [DE] Fed. Rep. of Germany ..... 2554685

[51] Int. Cl.[2] ..... B65D 85/68

[52] U.S. Cl. ..... 206/319; 105/367; 206/521; 220/4 B; 248/20

[58] Field of Search ..... 105/367; 248/20, 119 R; 220/4 B, 5 A; 206/319, 326, 335, 583, 587, 521; 217/49

[56] References Cited

U.S. PATENT DOCUMENTS

| | | | |
|---|---|---|---|
| 2,613,807 | 10/1952 | Higbee | 206/319 |
| 2,674,371 | 4/1954 | Blackinton | 206/319 |
| 2,685,964 | 8/1954 | Brown | 206/319 |
| 2,729,327 | 1/1956 | Roy | 206/319 |
| 2,868,368 | 1/1959 | Beach | 206/319 |
| 3,571,533 | 3/1971 | Coleman | 220/5 A |

FOREIGN PATENT DOCUMENTS

| | | | |
|---|---|---|---|
| 1,280,781 | 11/1960 | France | 206/319 |
| 80,003 | 3/1961 | France | 206/319 |
| 1,280,673 | 11/1960 | France | 206/319 |
| 1,280,714 | 11/1960 | France | 206/319 |
| 1,249,758 | 9/1967 | Fed. Rep. of Germany | 220/5 A |

*Primary Examiner*—William Price
*Assistant Examiner*—Bruce H. Bernstein
*Attorney, Agent, or Firm*—Craig & Antonelli

[57] ABSTRACT

A gas turbine container which includes a lower container member and a separable upper container member with the lower container member serving as a transport stand and including at least the entire rear wall of the container with the separable upper member including at least the entire front wall of the container. The lower container member is provided with recesses extending in the longitudinal direction with guide rails being arranged at wall sections of the recesses which wall sections extend in parallel with a horizontal longitudinal center plane of the container. A supporting frame is provided for supporting the container with damping or cushioning elements being disposed between the guide rails and the supporting frame.

11 Claims, 2 Drawing Figures

GAS TURBINE CONTAINER

Figure 1:
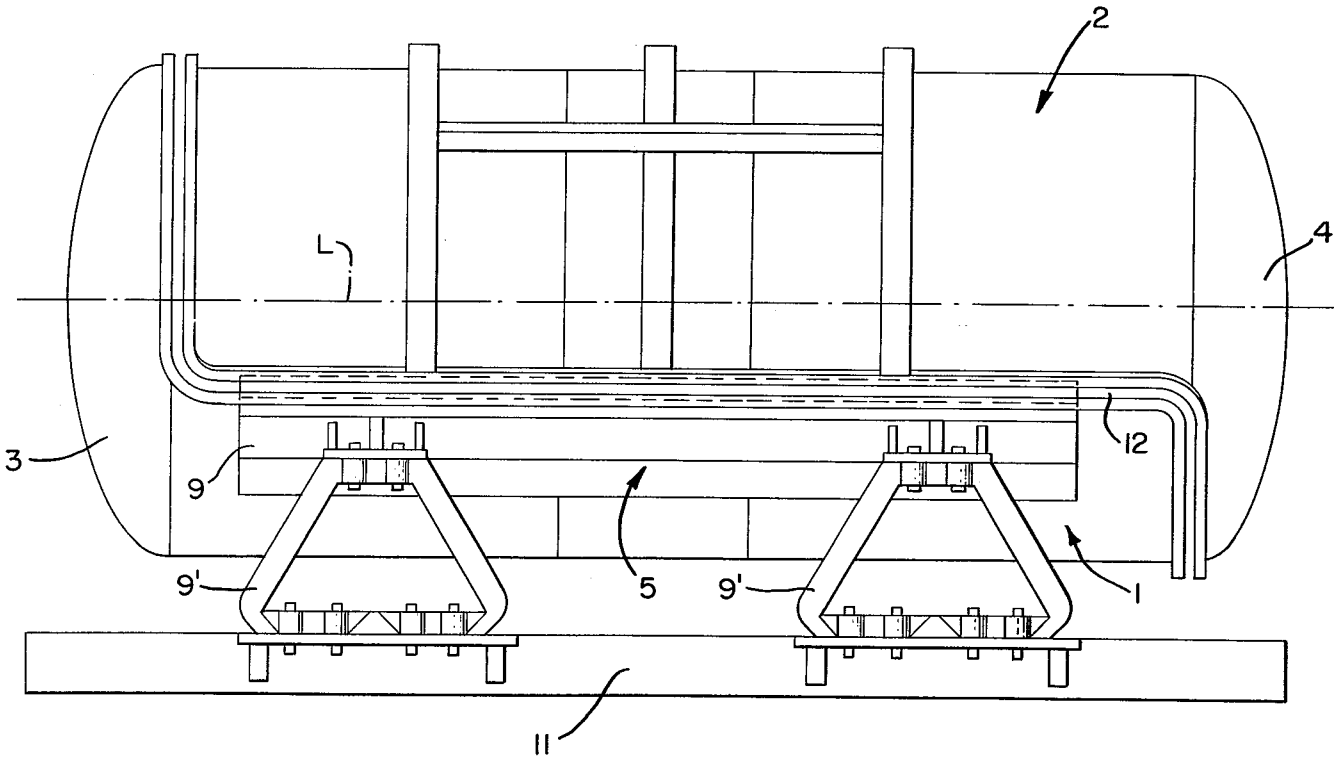

The present invention relates to a container for gas turbine engines and, more particularly, to a container for gas turbine jet engines which includes a lower container member and a separable upper container member.

Proposed transport or storage containers for turbine engines, especially turbine jet engines, include a lower container member and an upper container member with the two members being separated from one another by a horizontally extending circumferential joint with the members being connected at the joint by way of flanges.

Unlike other proposed containers fashioned of plastic and subject to leaking, the above-noted transport and storage container is made of steel with the lower member being supported on skids and the upper member being saddle-shaped so as to enable the containers to be stacked one on top of the other. In the proposed storage and transport container, the engine is supported within the container by way of flexible rubber elements which serve for cushioning or damping undesirable vibrations of the engine.

One advantage of the proposed transport or storage container resides in the fact that the container can be made air-tight with the closed or sealed container being pressurized internally to prevent any external environment, such as moisture, from entering the container.

For certain engines, the flexible rubber cushioning elements must be of a relatively large size, and, in the proposed container system, the necessary cushioning can be maintained only if the container is made sufficiently large. However, by increasing the size of the container, there results an additional weight, manufacturing expenditure, and expenditure of material which is not warranted in practical operation.

A further disadvantage of the proposed container system resides in the fact that the jet engine can be removed from it or placed into it only in a vertical direction so that a special lifting apparatus and a relatively complex loading and unloading procedure is required.

A further container system has been proposed wherein a supporting frame carrying the engine on cushioning and flexible elements has placed over it a wood, plastic, or lattice-type upper container member. In such construction, the flexible cushioning elements of the engine are outside the container proper so that such elements can be sized very liberally for optimum cushioning and flexibility without adding to the size of the container. However, the main disadvantage of this proposed container system resides in the fact that the container leaks and to compensate for this leakage and to prevent damage to the engine, a welded plastic cover is disposed over the engine to protect the same.

Further disadvantages of the last-metnioned container system reside in the fact that extended storage and stacking is largely prevented due to the placement of the cushioning elements exteriorly of the container.

When considering the development of a container for gas turbine engines, especially gas turbine jet engines, certain requirements must be met, which requirements may be summarized as follows:

1. Safe support for the gas turbine jet engine in transit;
2. Protection of the gas turbine jet engine from unnecessary jolts and vibrations in loading and transit, which jolts and vibrations may exceed the recommendations specified by the engine manufacturer;

3. Suitability for air/land/sea transportation;
4. Protection of the gas turbine engine from exposure to elements leading to corrosion in accordance with national requirements or specifications of the engine manufacturer;
5. Protection of the gas turbine jet engine from adverse physical factors affecting the functional reliability and airworthiness of the engine;
6. Long-term storage of the engine while protecting the same from corrosion and adverse physical factors;
7. Moderate dimensions and weight;
8. Easy handling when loading and shipping and when packing and unpacking the engine;
9. Low costs of development, manufacture and maintenance of the container;
10. Resistance of the container to oil, fuel, high/low temperatures and ozone in accordance with the national requirements;
11. Low maintenance expenditure and good maintainability of the container; and
12. Suitability of the container for stacking.

The present invention is concerned with the task to provide an improved, structurally simple gas turbine storage or transport container which satisfies the above-mentioned requirements while eliminating the aforementioned shortcomings encountered in the prior art.

The underlying problems are solved according to the present invention by providing a transport or storage container having a lower supporting container member which functions as a transport stand with guides being provided for receiving the gas turbine engine and mounting the same and with the container being arranged so as to damp unnecessary adverse vibrations.

According to one advantageous feature of the present invention, the lower supporting container member, serving as the transport stand, includes at least the entire rear wall of the container with a separable upper member of the container including at least the entire front wall of the container. By virtue of this construction, with the lower member serving as the transport stand, a considerable weight reduction is realized. Additionally, the provision of the complete front and rear walls respectively on the lower and upper members facilitates the loading of the engine thereby dispensing with the heretofore required complex lifting apparatus for handling and loading the engine.

According to a further advantageous feature of the present invention, the lower supporting container member is provided with lateral recesses extending in the longitudinal direction of the container with the guides formed as, for example, guide rails for the engine being arranged on the wall sections of the recesses which extend in parallel with a horizontal longitudinal center plane of the container. Preferably the container rests on a supporting frame arranged beneath the guide rails with cushioning elements being interposed between the guide rails and the supporting frame.

By virtue of the container construction of the present invention, the transport stand itself has shock-absorbing elements whereby a minimization of jolts and vibrations which occur, for example, in loading and transport can much more be effectively realized than in situations where the shock absorbers are arranged within the container. As the movements from vibration damping are made by the engine and the container, the container is allowed to hug or surround the engine for low bulk and weight. Furthermore, the upper container member in accordance with the present invention essentially functions as an unstressed protective envelope rather than a stressed element; therefore, the wall thicknesses of the upper container member can be considerably reduced.

Preferably, in accordance with the present invention, the container is formed of a metallic material such as aluminum or steel; however, it is also possible to construct the container of a plastic material or fiber-reinforced material.

While a plastic material may be employed to manufacture the container of the present invention, certain additional measures need then be taken due to the potential leakage problems which may result in a plastic container. Specifically, an additional plastic cover may be necessary to protect the engine against corrosion. Moreover, in a plastic container, when sealed for pressurization, such container may have to be stiffened to a point wherein the weight of the plastic container may not offer savings over the metal container. Furthermore, even when considering the effort required for maintaining metal containers, though it is moderate, because of the high development and series production costs of plastic containers, a metallic container may be preferable in certain situations.

Apart from the weight reduction achieved in accordance with the present invention by virtue of the construction of the upper and lower container members by constructing the container of aluminum, an even greater reduction in the overall container weight can be realized.

Additionally, according to further advantageous features of the present invention, the engine may be secured in the container on rails conforming to the rails of a given transportation system. Since the container of the present invention is not merely split horizontally but as the upper portion is removed together with the front face, the engine can be rolled into the container without any need for a lifting apparatus. Conversely, the engine can be removed from the container of the present invention onto a transport dolly or the like fitted with rails conforming to the rails provided in the container. Additionally, even if the upper container member of the present invention is made of a steel, such member would nevertheless be light enough for manual removal without any additional lifting apparatus.

Accordingly, it is an object of the present invention to provide a container for gas turbine engines which avoids by simple means the aforementioned shortcomings and drawbacks encountered in the prior art.

Another object of the present invention resides in providing a container for gas turbine engines which is relatively simple in construction and therefore relatively inexpensive to manufacture.

A further object of the present invention resides in providing a container for gas turbine engines which facilitates the loading and unloading of the engine therefrom.

A still further object of the present invention resides in providing a container for gas turbine engines which permits a long-term storage of the engine and protection of the same from corrosion and adverse physical factors.

Figure 2:
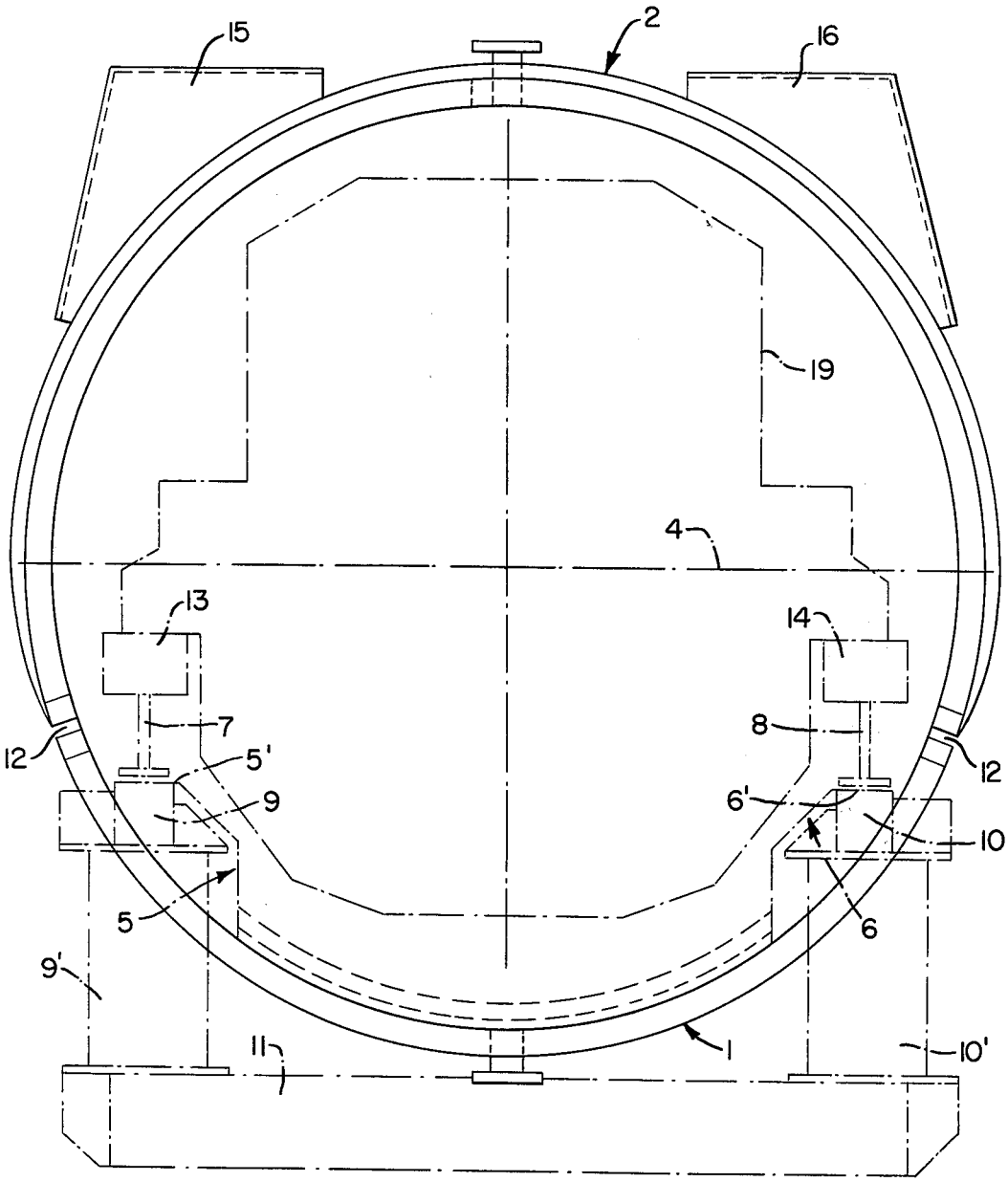

These and further objects, features, and advantages of the present invention will become more apparent from the following description when taken in connection with the accompanying drawing which shows, for purposes of illustration only, one embodiment in accordance with the present invention, and wherein:

FIG. 1 is a side view of a storage and/or transport container in accordance with the present invention; and FIG. 2 is a cross-sectional view of the container of FIG. 1 on an enlarged scale.

Referring now to the drawings wherein like reference numerals are used in both views to designate like parts and, more particularly, to FIG. 1, according to this figure, the container for gas turbine engines, especially for gas turbine jet engines, includes a lower supporting container member generally designated by the reference numeral 1 and a separable upper container member generally designated by reference numeral 2. The lower supporting container member 1, serving as a transport stand, includes at least the entire rear wall 3 of the container. The separable upper container member 2 includes at least an entire front wall 4 of the container.

As shown most clearly in FIG. 2, the lower container member 1 is provided with lateral recesses generally designated by the reference numerals 5, 6 which extend in the longitudinal direction of the container. The recesses 5, 6 have wall sections 5′, 6′ extending parallel to a horizontal longitudinal center plane H of the container at which wall sections 5′, 6′ are arranged guide rails 7, 8 for mounting a schematically illustrated engine 19. Beneath the rails 7, 8 the weight of the container rests on a supporting frame 11 by way of longitudinal members 9, 10 and shock absorbers 9′, 10′ which may be fashioned as, for example, hard-rubber vibration mounts or the like.

With the lower supporting container member 1 and the upper supporting container member 2 being arranged in an assembled condition, a joint 12 is defined between the lower container member 1 and the upper container member 2 which joint extends in parallel with the longitudinal center line L (FIG. 1) of the container with the joint 12 being arranged below the horizontal longitudinal center plane H such that the upper member 2 of the container comprises nearly two-thirds of the entire circumference of the container.

To aid in the guiding and resting of the engine 19, rollers 13, 14 or other sliding means may be provided on the rails 7, 8.

The rails 7, 8 and lateral recesses 5, 6 add to the rigidity of the lower container member thereby enabling the member to serve as a transport stand.

To enable the stacking of the containers, saddles 15, 16 may be arranged at the upper member 2.

Preferably the container is manufactured from a metallic material such as, for example, steel or aluminum. However, it is also possible in accordance with the present invention to manufacture the container from a plastic material or a fiber-reinforced material.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A container for a gas turbine engine, comprising:

means for supporting the container;

guide means arranged in the container for guidingly mounting the gas turbine engine therein;

damping means interposed between said guide means and said supporting means for damping vibration of the container;

a lower container member mounted on said damping means;

recess means arranged in the lower container member, said recess means supporting said guide means and being supported by said damping means so that all the force of the weight of the gas turbine engine is transmitted directly downward through the vertical axes of the guide means, the recess means, and the damping means, to be absorbed by the damping means; and an upper container member joining said lower container member and having a wall arranged at least at one end thereof to define an entire end wall of the container, said upper container member being removable from the lower container member so that the gas turbine engine may be removed from the container either directly in a horizontal line along the central longitudinal axis of the container or directly upward along the central vertical axis of the container.

2. A container for a gas turbine engine, according to claim 1, wherein said recess means includes wall sections arranged in a horizontal plane of the container.

3. A container for a gas turbine engine, according to claim 1, further comprising a joint between the lower and upper container members, said joint extending parallel to the central longitudinal axis of the container.

4. A container for a gas turbine engine, according to claim 3, wherein said joint is further located below the horizontal center plane of the container.

5. A container according to claim 1, wherein said guide means includes guide rail means arranged at said wall sections for guidingly receiving the gas turbine engine.

6. A container according to claim 5, wherein said lower container member serves as a transport stand.

7. A container according to claim 1, wherein the container is constructed of a metallic material.

8. A container according to claim 7, wherein said metallic material is steel.

9. A container according to claim 7, wherein said metallic material is aluminum.

10. A container according to claim 1, wherein the container is constructed of a reinforced fiber material.

11. A container according to claim 1, wherein the upper container member comprises almost two-thirds of an outer circumference of the container.

* * * * *